United States Patent [19]

Sands

[11] Patent Number: 4,615,488

[45] Date of Patent: Oct. 7, 1986

[54] TOY WATER GUN HAVING THREE DIRECTIONAL NOZZLES

[76] Inventor: Ned R. Sands, 2230 Holly Ave., Escondido, Calif. 92027

[21] Appl. No.: 628,799

[22] Filed: Jul. 9, 1984

Related U.S. Application Data

[63] Continuation-in-part of Ser. No. 553,037, Nov. 18, 1983.

[51] Int. Cl.[4] ..... B05B 1/14

[52] U.S. Cl. ..... 239/391; 222/79; 239/394; 239/444; 239/447

[58] Field of Search ..... 239/390, 391, 397, 438, 239/444, 447, 449, 394, 289; 222/72, 78, 79, 386, 446

[56] References Cited

U.S. PATENT DOCUMENTS

| | | | |
|---|---|---|---|
| 933,961 | 9/1909 | Demoulin | 222/79 |
| 1,031,526 | 7/1912 | Cloud, Jr. | 124/65 |
| 1,394,456 | 10/1921 | Wanat | 124/55 X |
| 1,417,031 | 5/1922 | Casorso et al. | 239/394 |
| 1,838,438 | 12/1931 | Nichols | 239/446 |
| 2,148,726 | 2/1939 | Brandt | 239/447 |
| 2,218,411 | 10/1940 | Albach et al. | 239/444 X |
| 2,313,994 | 3/1943 | Grant | 239/444 X |
| 3,058,670 | 10/1962 | Marotto et al. | 239/390 X |
| 3,225,972 | 12/1965 | Brumbach | 239/394 X |
| 4,141,503 | 2/1979 | Beck | 239/394 |
| 4,221,334 | 9/1980 | Christopher | 239/394 |
| 4,461,426 | 7/1984 | Christopher | 239/394 |

*Primary Examiner*—Andres Kashnikow

*Attorney, Agent, or Firm*—Laurence R. Brown

[57] ABSTRACT

A generally cylindrical nozzle assembly having several relatively rotatable cylindrical members directs water streams in different directions in response to manual rotation of these members and fits on a water gun to provide modes of operation including the forward, sideward and backward discharge of streams of water. A rotatable cap has a plurality of orifices for alignment with passageways transmitting water streams as the rotatable members are relatively positioned manually to discharge water pumped from an attached water gun in different directions.

1 Claim, 7 Drawing Figures

TOY WATER GUN HAVING THREE DIRECTIONAL NOZZLES

This application is a continuation-in-part of my copending application Ser. No. 553,037, filed Nov. 18, 1983 for Toy Water Gun With A Multiplicity of Operation Modes.

TECHNICAL FIELD

This invention relates to toy water guns and more particularly it relates to nozzles for water guns that direct water in different directions.

Fluid discharging guns having movable piston rods and a fluid containing chamber have long been known as evidenced by U.S. Pat. No. 1,031,526, issued to N. H. Cloud, Jr. on July 2 1912. Also the operation of such guns in multiple modes is known as evidenced by U.S. Pat. No. 1,394,456, issued to J. Wanat on Oct. 18, 1921. This patent discloses a combination pop gun, water gun and whistle attained by a variety of inlet and outlet ports for the water gun barrel.

My said copending patent application discloses a water gun that is able to discharge water in three different directions, namely forward, to the side and back toward the operator manipulating the water gun piston plunger. This invention is directed to an improved three directional nozzle adapter for a water gun barrel.

DISCLOSURE OF THE INVENTION

This invention provides a three directional nozzle for a water gun that may be selectively programmed to discharge water forward, to the side or backward by means of manual setting of rotatable nozzle parts to select one of three corresponding discharge orifices.

BRIEF DESCRIPTION OF THE DRAWINGS

In the drawings, wherein like reference characters are used to identify corresponding parts throughout the various views.

THE PREFERRED EMBODIMENT

Figure 1:
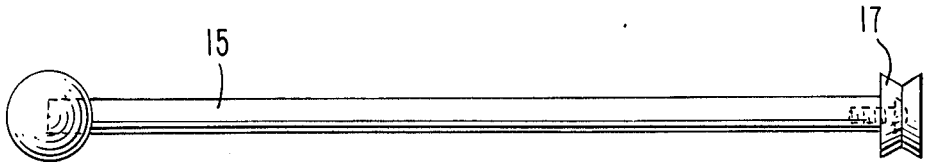
FIG. 1 is a side view of a plunger-diaphragm piston assembly for a water gun.
Figure 2:
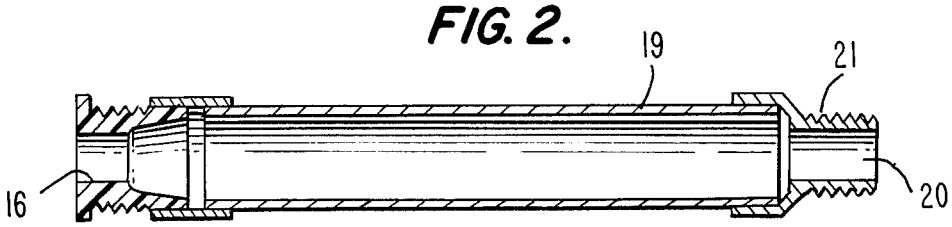
FIG. 2 is a sectioned side view of a water reservoir barrel of a water gun operable with the piston of FIG. 1.

A basic water gun piston and barrel assembly is shown in FIGS. 1 and 2. Thus piston rod 15 is journalled in bushing 16 to guide the diaphragm 17 along the inside diameter of the barrel cylinder 19. Water then can be sucked into the front aperture 20 of the barrel, which serves as a storage reservoir, by manual manipulation of the piston and can thereafter be discharged. The threaded fitting 21 permits mounting of a suitable nozzle. Throughout, the materials are not critical, but are sectioned to represent acceptable materials. Thus the cylinder 19 is metal, such as aluminum, the bushing 16 is plastic, etc.

Figure 3:
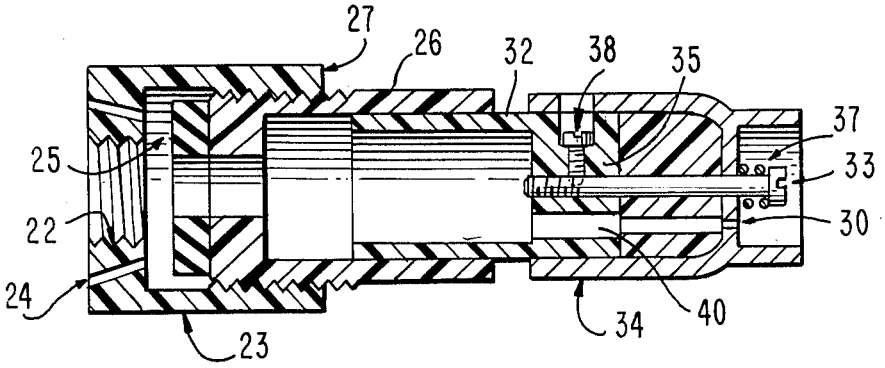
FIG. 3 is a sectioned side view of a three directional nozzle embodiment of the invention which may be attached to the water gun barrel of FIG. 2, FIGS. 4A and 4B are respectively side and front end views of a rotatable nozzle cap for selecting orifices for discharging water either to the front, side or rear.
Figure 4A:
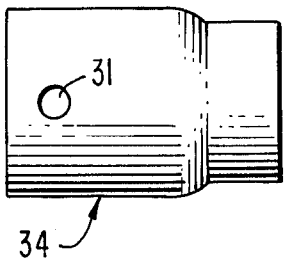
Figure 4B:
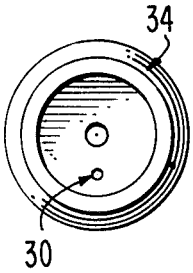

The generally cylindrical nozzle of FIG. 3 has threads 22 for fitting onto a suitable water gun, such as that of FIGS. 1 and 2 at the threaded fitting 21. The coupling joint 23 also serves as a reverse direction outlet nozzle by means of the orifices 24. Sealing gasket 25 may thus be axially moved against and away from the apertures 24 by means of manual rotation of fitting 23 relative to coupler 26 at screw threads 27. For front or side discharge of water, the orifices 24 are sealed by moving the gasket 25 against the orifices 24. For rearward discharge of water the front orifices are closed as hereinafter discussed.

For selective actuation of either forward or sideward discharge of water at front nozzle orifices 30 and 31 respectively, the mounting member 32 has secured thereto by means of screw 33 the rotatable cap 34 and the inner sealing gasket member 35. Cap 34 is rotatably mounted with aperture 36 disposed about screw 33 and journalled on the cylindrical coupler 26. No axial motion of cap 34 is normally permitted by action of bias spring 37 adjustable by screw 33 engagement with the mounting member 32. The spring 37 furthermore frictionally holds the cap against rotation out of a resident angular position about the screw 33 shaft, which is non-rotatably held axially in the nozzle assembly. Set screw 38 maintains the spring bias desired and prevents change with cap 34 rotation which would otherwise tend to rotate screw 33.

By rotating cap 34 the passageway 40 in the sealing plug member 35 can be aligned with the aperture 30 in the cap for forward discharge of water. Rotation of the cap 34 to an unapertured portion of sealing plug 35 will seal the forward discharge orifices and permit rearward discharge through orifices 24, provided that the parts 23 and 26 are relatively rotated to space gasket seal 25 away from the orifices 24.

Figure 5A:
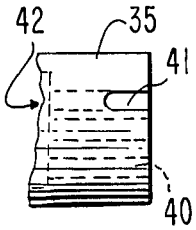
FIGS. 5A and 5B are respectively side and end views of a water directing valve part cooperatively operable with the nozzle cap of FIGS. 4 to permit manual selection of a desired direction of water discharge.
Figure 5B:
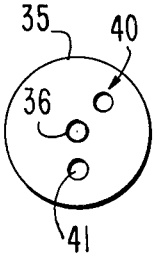

For sideward discharge through cap 34 orifice 31, the cap 34 is rotated to align the side orifice 31 with the aperture 41 extending partially through the sealing plug 35, as best seen from FIG. 5A. Thus, the front end 42 of the sealing plug 35 closes off aperture 41, which is accessible from the rear water reservoir end only. In this sidewards discharge position of cap 34 the front aperture 30 is sealed shut by the sealing plug 35 front face. In other words, the aperture 30 is not aligned with the passageway 40 through the sealing plug 35. The central passageway 36 through the sealing plug 35 is for passage of the cap retaining screw 33.

It is seen therefore that the generally cylindrical nozzle assembly embodiment of FIG. 3 directs a stream of water derived from a manually controlled source of water under pressure, such as a water gun, in different directions. Thus, water streams are diverted in three directional paths by simple and effective manually operated valving means comprising relatively rotatable cylindrical members in the nozzle manually actuated for opening and closing a corresponding set of water discharge orifices, which are selected at different relative angular positions of the rotatable cylindrical members. The primary valving member comprises a cap journalled to rotate about an axially disposed shaft held non-rotatably in the nozzle assembly.

Those novel features of this invention believed descriptive of the nature and spirit of the invention are defined with particularity in the following claims.

I claim:

1. A toy water gun for selectively directing a stream of water in one of a plurality of directions comprising a manually operable cylindrical plunger-diaphragm piston water pump, a nozzle assembly connected to the discharge of said water pump axially downstream of said pump comprising in combination, means coupling said axially disposed cylindrical nozzle assembly to said pump having openings therein directed rearwardly so that water may be selectively delivered under pressure by manual control of said pump in the direction of said pump, relatively rotatably cylindrical members positioned axially in said nozzle assembly for manually opening and closing a plurality of axially disposed water discharge orifices to selectively direct streams of water in different directions at different relative angular positions of said axially disposed relatively rotatable cylindrical members in said axially disposed cyklindrical nozzle assembly, wherein one of the rotatable members comprises a cap member journalled to rotate about an axially positioned shaft held non-rotatably in said axially disposed nozzle assembly, means for holding the cap member in a fixed axial position along the axis of the nozzle assembly, and gasket means carried by said nozzle assembly positioned to direct water axially along the nozzle to said axially disposed plurality of water discharge orifices to selectively direct streams of water in directions at different relative angular positions of said relatively rotatable cylindrical members in said axially disposed nozzle assembly other than rearwardly when rotated in one direction and upon rotation of said nozzle in a reverse direction water is directed through the rearwardly openings in said nozzle toward the pump.

* * * * *